United States Patent [19]

Munguia

[11] Patent Number: 4,789,200

[45] Date of Patent: Dec. 6, 1988

[54] COMBINED CHAIR AND UMBRELLA SUPPORT STRUCTURE

[76] Inventor: Richard Munguia, 8425 E. Amethyst St., Tucson, Ariz. 85715

[21] Appl. No.: 78,582

[22] Filed: Jul. 27, 1987

[51] Int. Cl.[4] ..... A47C 29/00

[52] U.S. Cl. ..... 297/184; 211/208; 248/161; 297/194; 297/DIG. 6; 403/377

[58] Field of Search ..... 297/188, 184, 194, DIG. 6; 248/161, 407; 403/377; 211/208, 204, 103, 4

[56] References Cited

U.S. PATENT DOCUMENTS

| | | | |
|---|---|---|---|
| 1,685,445 | 9/1928 | Bash | 248/161 X |
| 1,921,460 | 8/1933 | Euring | 297/184 X |
| 3,220,766 | 11/1965 | Kates | 297/184 |
| 3,637,184 | 1/1972 | O'Brien | 297/194 X |
| 3,879,086 | 4/1975 | Moceri | 297/184 |
| 3,935,874 | 2/1976 | Cohen | 297/184 X |
| 4,063,701 | 12/1977 | Wray | 297/188 X |
| 4,112,957 | 9/1978 | Biven | 297/184 X |
| 4,271,566 | 6/1981 | Perina | 297/DIG. 6 X |
| 4,330,798 | 11/1981 | Musgrove et al. | 297/184 |
| 4,645,167 | 2/1987 | Hardwick | 297/184 X |

FOREIGN PATENT DOCUMENTS

| | | | |
|---|---|---|---|
| 2420916 | 11/1975 | Fed. Rep. of Germany | 297/184 |
| 2322565 | 4/1977 | France | 297/184 |
| 183651 | 7/1936 | Switzerland | 297/184 |

*Primary Examiner*—Kenneth J. Dorner
*Assistant Examiner*—Thomas A. Rendos
*Attorney, Agent, or Firm*—Leon Gilden

[57] ABSTRACT

A fisherman's boat chair is provided with a tubular support for retaining an umbrella positionable over the chair. The height of the umbrella is adjustable by the selective positioning of a pin through one of a plurality of available through-extending apertures in the support, and the shank of the umbrella is supported by the pin. Velcro strips are used to prevent umbrella rotation and withdrawal from the support after it has been placed in position. The modified chair may also include a quickly removable and attachable beverage holder.

1 Claim, 3 Drawing Sheets

COMBINED CHAIR AND UMBRELLA SUPPORT STRUCTURE

BACKGROUND OF THE INVENTION

1. Field of the Invention

The present invention relates to support structures, and more particularly pertains to a new and improved umbrella support utilizable in combination with a sportsman's chair.

2. Description of the Prior Art

Supports for attaching umbrellas to chairs are well known in the prior art. Typical examples of such supports are to be found in U.S. Pat. No. Des. 219,377 which issued to W. Peery on Dec. 8, 1970; U.S. Pat. No. 2,860,566 which issued to Allsup et al on Nov. 18, 1958; and U.S. Pat. No. 3,879,086 which issued to F. Moceri on Apr. 22, 1975. All of these patents disclose umbrella supports attached to chair structures wherein the umbrellas may be adjusted in height relative to the chair to thus accommodate the desires of the user. However, most of these support structures involve the use of some type of locking means to secure the umbrella in position after it has been adjusted to the preselected height, and it then becomes difficult to quickly and easily remove or further adjust the height of the umbrella. Recognizing that there are a large number of patents relating to such structures and that these umbrella supporting structures represent a substantially crowded art, it is evident that there is a substantial interest in developing even further support structures which would make the height adjustment and removability of an umbrella much more easier. In this regard, there is a continuing need for supporting structures and other convenience devices attachable to chairs, and the present invention substantially addresses this need.

SUMMARY OF THE INVENTION

In view of the foregoing disadvantages inherent in the known types of umbrella supporting devices now present in the prior art, the present invention provides an improved umbrella support structure which is directly attachable to the backside of a chair wherein an umbrella can be easily and quickly adjusted in height or removed from the support structure as desired without the necessity of releasing threaded fasteners and other difficult to use attachment devices. As such, the general purpose of the present invention, which will be described subsequently in greater detail, is to provide a new and improved umbrella supporting structure utilizable in combination with a chair which has all the advantages of the prior art umbrella supporting devices and none of the disadvantages.

To attain this, the present invention comprises a tubular member which is fixedly and permanently secured to the back of a chair. The shank of an umbrella is positionable within the tubular member, and the length of travel of the shank within the member is controlled by a removable pin positionable within an interior portion of the member. The pin is positionable in one of a plurality of spaced-apart apertures to thus provide the selective height adjustment of the umbrella. Once the umbrella has been positioned at a selected height within the tubular member, a strip of Velcro (Trademark) attached to the member may be directly connected to a further strip of Velcro (Trademark) attached to the shank of the umbrella. The umbrella is then selectively locked in position against rotation within the tubular member, and is also prevented from becoming disengaged therefrom as could occur if a gust of wind were to lift the umbrella out of the member. The combination of the invention further includes a quickly attachable and removable beverage holder that is desirably attached to a side portion of a chair.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways.

Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved umbrella supporting structure which has all the advantages of the prior art umbrella supporting structures and none of the disadvantages.

It is another object of the present invention to provide a new and improved umbrella supporting structure which may be easily and efficiently manufactured and marketed.

It is a further object of the present invention to provide a new and improved umbrella supporting structure which is of a durable and reliable construction.

An even further object of the present invention is to provide a new and improved umbrella supporting structure which is susceptible of a low cost of manufacture with regard to both materials and labor, and which accordingly is then susceptible of low prices of sale to the consuming public, thereby making such umbrella supporting structures economically available to the buying public.

Still yet another object of the present invention is to provide a new and improved umbrella supporting structure which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
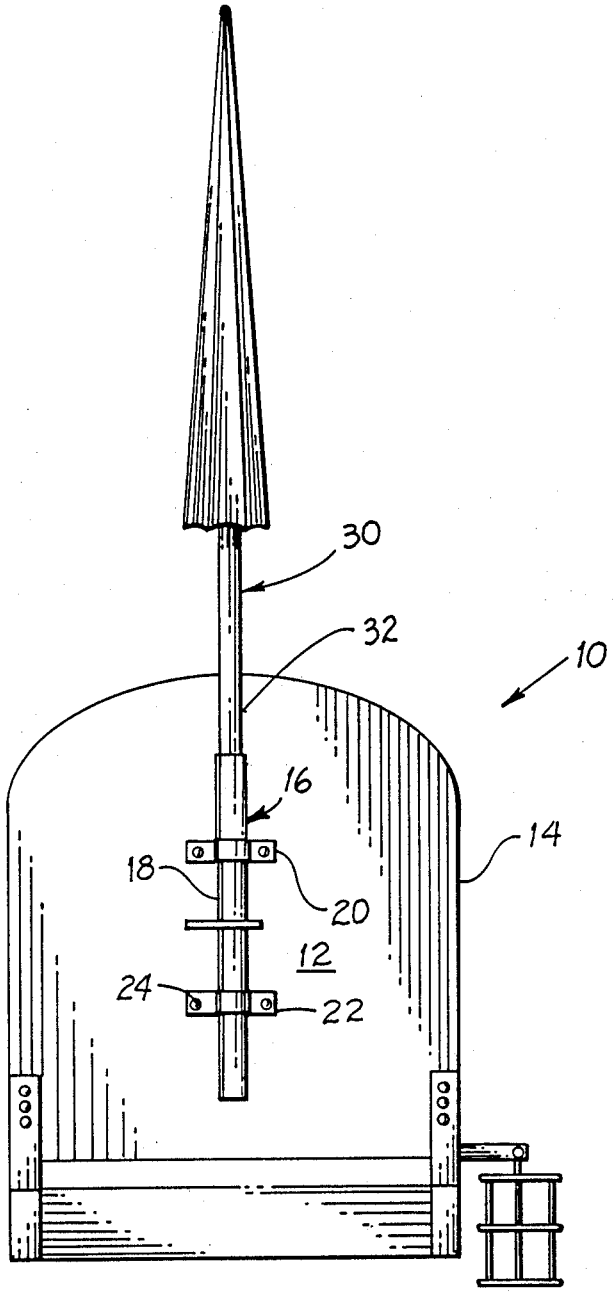
FIG. 1 is a front elevation view of the umbrella support structure comprising the present invention.
Figure 2:
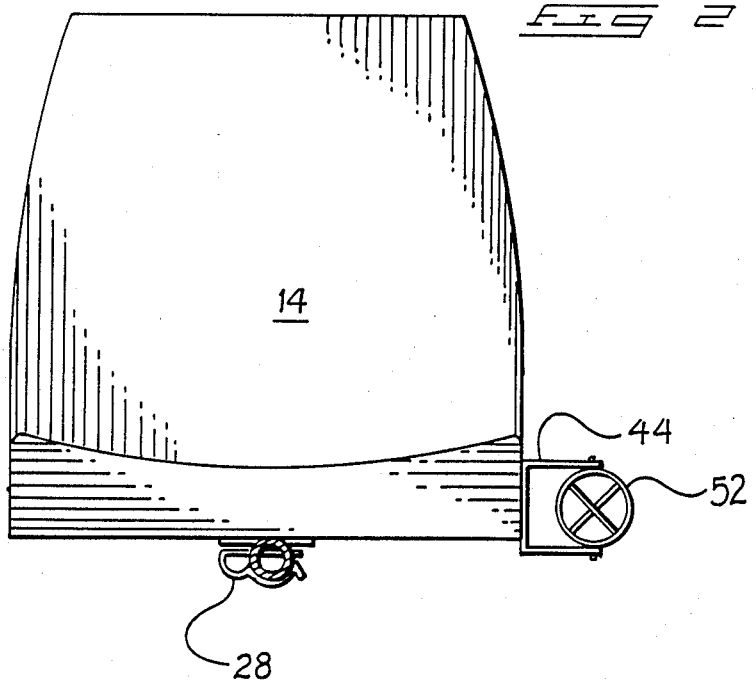
FIG. 2 is a top plan view of the invention.

With reference now to the drawings, and in particular to FIGS. 1–4 thereof, a new and improved umbrella support structure and beverage holder on a sportsman's chair embodying the principles and concepts of the present invention and generally designated by the reference numeral 10 will be described.

More specifically, it will be noted that the invention 10 is designed to be attached to the back side 12 of a conventional sportsman's chair 14 of the type typically utilized in a boat or the like. In a preferred embodiment, the invention 10 includes an umbrella support structure 16 comprising a length of conduit 18 fixedly secured to the back 12 of the chair 14 by a pair of conventional clamps 20, 22. The clamps 20, 22 may be attached to the back 12 of the chair 14 by any conventional means, such as through the use of a plurality of threaded fasteners 24.

Figure 3:
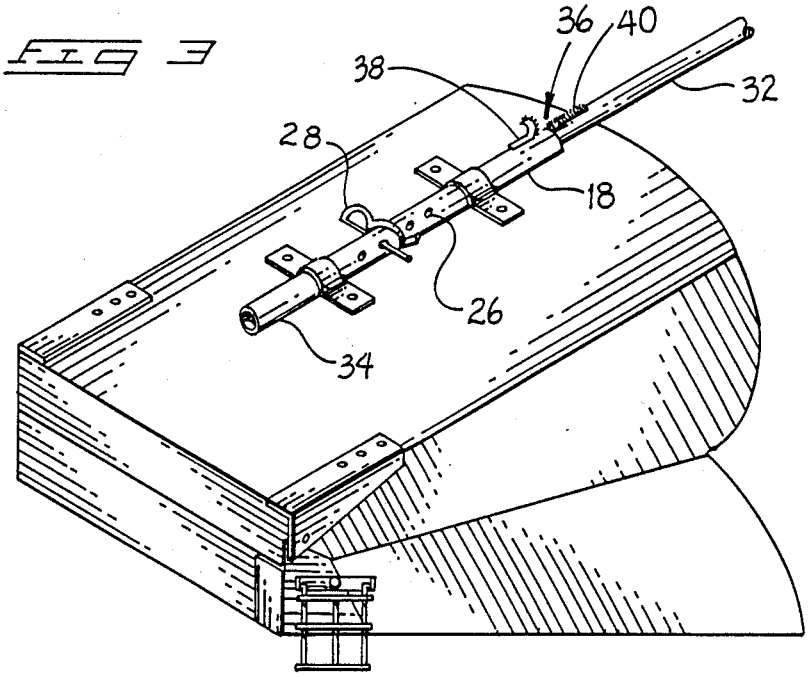
FIG. 3 is a perspective view of the invention.

As best illustrated in FIG. 3, the conduit section 18 may be provided with a plurality of through-extending apertures 26 designed to removeably receive a manually positionable clip pin 28. As shown in both FIGS. 1 and 3, an umbrella 30 may have its shank portion 32 retained within the conduit section 18 and is supported thereby. In this respect, the shank 32 is telescopingly received within the hollow interior portion of the conduit 18 to effect the desired support function. In the most simple embodiment of the present invention, the conduit 18 could have its lowermost section 34 crimped together to prevent the shank 32 from sliding completely through the conduit, thereby to operably retain the umbrella 30 in position relative to the chair 14. However, the present invention is designed to facilitate selective height adjustment of the umbrella 30 by having the shank 32 rest directly against the pin 28. Depending upon which aperture 26 the pin 28 is inserted through, selective height adjustment is available.

Once the umbrella 30 has been selectively positioned at a desired height within the conduit 18, it can be appreciated that a gust of wind could cause the umbrella to rotate or to be pulled out of the conduit. The umbrella 30 is prevented from rotating or from being disengaged from the conduit 18 by a Velcro (Trademark) fastener structure 36. More particularly, a first strip 38 of Velcro (Trademark) is attached to an exterior surface of the conduit 18 and a second engagable strip 40 is positioned along an axial length of the shank 32. Once the umbrella 30 is positioned as desired, the Velcro (Trademark) strips 38, 40 can be brought into locking engagement to prevent any further movement of the shank 32 relative to the conduit 18.

Figure 4:
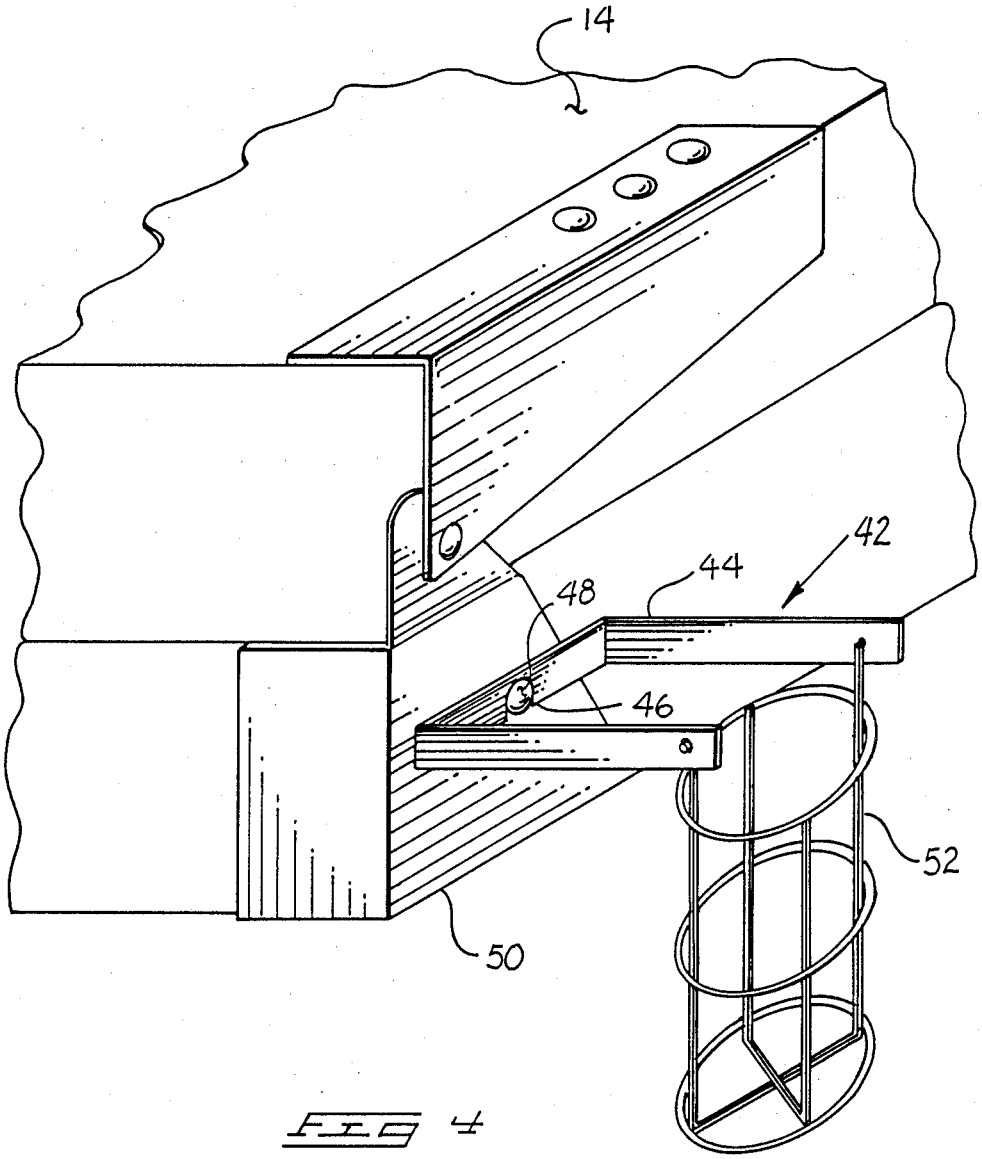
FIG. 4 is a perspective view of the beverage holder forming a part of the present invention.

The combination of the present invention 10 may also include a selectively attachable and removable beverage holder 42. As best illustrated in FIG. 4, the beverage holder 42 could include a U-shaped bar member 44 having a slot 46 which is positionable over an extended fastener 48 attached to the frame structure 50 of the chair 14. A beverage holding cage 52 is pivotally attached to the U-shaped bar member 44 and is of a conventional design. The weight of a beverage container will retain the bar member 44 in engagement with the extending pin 48 and will also allow for the desired pivotal movement thereof in a well understood manner.

As to the manner of usage and operation of the present invention, the same should be apparent from the above description. Accordingly, no further discussion relative to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved umbrella support structure in combination with a chair, said structure comprising:

a chair;

a clamp means attaching a conduit means to a rear surface of said chair; an umbrella having a shank portion; said conduit means oriented for receiving said shank portion, and umbrella height adjustment means, said adjustment means including a manually removable and insertable clip pin positionable through said conduit means upon which said shank portion is positioned, said clip pin being selectively positionable along an axial length of said conduit means through one of a plurality of through extending apertures positioned along an axial length of said conduit means, and further including shank locking means wherein said locking means comprises hook and loop fasteners wherein a first section of said hook and loop fasteners is attached to an exterior surface of said conduit means and a second section of said hook and loop fasteners is attached to an exterior surface of said shank portion, said first and second sections being engageable together to effect a locking function.

* * * * *